US010098394B1

(12) United States Patent
Infante

(10) Patent No.: US 10,098,394 B1
(45) **Date of Patent: *Oct. 16, 2018**

(54) GLOVE SYSTEM HAVING LIGHTING AND FASTENING MEANS ALLOWING A USER TO EASILY DON AND DOFF EACH GLOVE AND ILLUMINATE WORK AREAS

(71) Applicant: ALICAT, LLC, Miami, FL (US)

(72) Inventor: Alfredo Infante, Miami, FL (US)

( * ) Notice: Subject to any disclaimer, the term of this patent is extended or adjusted under 35 U.S.C. 154(b) by 198 days.

This patent is subject to a terminal disclaimer.

(21) Appl. No.: 15/188,034

(22) Filed: Jun. 21, 2016

Related U.S. Application Data

(63) Continuation-in-part of application No. 14/621,366, filed on Feb. 12, 2015, now Pat. No. 9,445,635.

(51) Int. Cl.

| | |
|---|---|
| ***A41D 19/015*** | (2006.01) |
| ***A41D 19/00*** | (2006.01) |
| ***A47G 25/90*** | (2006.01) |
| ***F21V 23/04*** | (2006.01) |
| ***F21L 4/08*** | (2006.01) |

(Continued)

(52) U.S. Cl.

CPC ..... *A41D 19/0157* (2013.01); *A41D 19/0024* (2013.01); *A41D 19/0037* (2013.01); *A41D 19/0048* (2013.01); *A41D 19/01505* (2013.01); *A41D 19/01523* (2013.01); *A41D 19/01529* (2013.01); *A41D 19/01547* (2013.01); *A41D 19/01594* (2013.01); *A47G 25/904* (2013.01); *F21L 4/08* (2013.01); *F21V 23/0464* (2013.01); *A41D 2300/32* (2013.01); *A41D 2300/322* (2013.01); *A44D 2203/00* (2013.01);

(Continued)

(58) Field of Classification Search

CPC ..... A41D 19/0034; A41D 19/01; A41D 19/01505; A41D 19/01529; A47G 25/904; A47G 19/00; A47G 19/0024; A47G 19/015; A47G 19/01523; A47G 19/01558; A47G 19/01547; A47G 19/0037; A47G 19/0048; A47G 19/01594; A61B 2019/046; A41F 1/06; A41F 1/002

USPC ..... 2/160, 159, 161.1, 161.6, 162

See application file for complete search history.

(56) References Cited

U.S. PATENT DOCUMENTS 2,710,409 A * 6/1955 Burandt ..... A41D 19/0034 2/160

5,450,658 A * 9/1995 Hicks ..... A41B 11/002 24/303

(Continued)

*Primary Examiner* — Gloria Hale

(74) *Attorney, Agent, or Firm* — Sanchelima & Associates, P.A.; Christian Sanchelima; Jesus Sanchelima

(57) ABSTRACT

A pair of protective gloves each glove having a glove body with finger portions that can be preselectively webbed together or each finger can be kept separated. The gloves are capable of withstanding heat, cold, puncture, shock and other similar hazards. One of the gloves includes an engagement member such as a magnetic member on the inner wrist portion of the glove that cooperates with an anchoring member on the inner wrist portion of the opposite glove that can be made of a ferromagnetic material to attract both gloves to each other. Once attracted a user can use a lip on the anchoring member to leverage his hands out of the gloves, thereby preventing the user from having to come in contact with the outside of the glove bodies when donning and doffing the gloves. Either or both glove assemblies can include a lighting assembly mounted thereon that provide illumination and visibility to a user desired work area.

23 Claims, 10 Drawing Sheets

(51) Int. Cl.
*F21L 4/02* (2006.01)
*F21V 23/06* (2006.01)
*F21V 33/00* (2006.01)

(52) U.S. Cl.
CPC ..... *F21L 4/02* (2013.01); *F21V 23/0414* (2013.01); *F21V 23/06* (2013.01); *F21V 33/0008* (2013.01)

(56) References Cited

U.S. PATENT DOCUMENTS

| | | | | |
|---|---|---|---|---|
| 7,058,986 | B2 * | 6/2006 | Pietzyk-Hardy | A41B 11/002 2/239 |
| 7,097,144 | B2 * | 8/2006 | Kohno | A47G 25/0607 223/85 |
| 8,746,517 | B2 * | 6/2014 | Esten | A47G 25/904 2/160 |
| 8,936,222 | B1 * | 1/2015 | Bastian | A45F 5/00 224/183 |
| 2006/0260021 | A1 * | 11/2006 | Kerr-Maddox | A41D 19/0034 2/159 |
| 2006/0289574 | A1 * | 12/2006 | Cacioppo, Jr. | A41D 19/0041 224/162 |
| 2007/0067890 | A1 * | 3/2007 | Pando | A61B 42/10 2/159 |
| 2012/0204319 | A1 * | 8/2012 | Gambordella | A41D 19/01547 2/161.1 |
| 2013/0227760 | A1 * | 9/2013 | Mahon | A41D 19/01 2/160 |

* cited by examiner

GLOVE SYSTEM HAVING LIGHTING AND FASTENING MEANS ALLOWING A USER TO EASILY DON AND DOFF EACH GLOVE AND ILLUMINATE WORK AREAS

BACKGROUND OF THE INVENTION

1. Field of the Invention

The present invention relates to a protective glove and, more particularly, to a protective glove using magnetics to facilitate donning, doffing, and storing the gloves. Additionally, the protective glove includes a lighting means to illuminate an area in which a user desires more visibility.

2. Description of the Related Art

Several designs for protective gloves have been designed in the past. None of them, however, include a magnet member that cooperates with an anchoring member to allow a user to easily and readily don and dof the gloves without touching the outer surface of the glove by another glover or the user's hand.

Applicant believes that a related reference corresponds to China patent No. CN203457846 issued to Yan Xiaoli for a loss prevention glove. The Xiaoli reference teaches of a glove having protective, shock absorbing properties. The Xiaoli also discloses the use of a magnet sewn to the inside of the elastic beam edge to be used to keep the gloves from being lost. However, it differs from the present invention because the use of magnets in the Xiaoli reference teach of keeping the gloves together once removed but not how a user can slip out of the gloves using the magnets as the present invention does. The Xiaoli reference does not motivate someone of ordinary skill in the art to create an anchoring member that cooperates with a magnet to withstand the directional forces exerted by a user's hands when removing the gloves.

Applicant believes that a related reference corresponds to U.S. Pat. No. 8,746,517 issued to Noel K. Esten for a glove arrangement. The Esten reference discloses of a protective glove using an auxiliary stand-alone member having retention spots to detachably couple with magnetic members on the back of each glove. However, it differs from the present invention because it requires an independent auxiliary member to operate. The present invention eliminates this requirement by having an anchoring member on the gloves that cooperates with magnetic members on the wrist portion of the gloves to allow a user to don and doff the gloves without the need for an external component. This permits a user to achieve the same function without the burden of carrying an auxiliary member. In addition, the auxiliary member may not be ideal for people of all sizes. Many different versions of the auxiliary member may be required to accommodate this problem. The Esten reference does not teach someone of ordinary skill in the art to mount magnetic members to the base of the gloves to cooperate with an anchoring member on the opposite glove for easy application and removal anywhere without requiring auxiliary members.

The present invention allows one glove to be removed at a time thereby permitting a user to have a free hand readily available for other tasks while the opposite hand can remain in the glove. The present glove system further includes a fastening means that the Esten reference does not teach. The fastening means is used the seal the wrist portion of each glove so that the gloves can be washed without getting the interior cavity (where the hands are inserted) wet. Moreover, the Esten reference fails to teach of a protective glove having lighting means mounted to the wrist portion of the protective glove.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide protective gloves able to withstand heat, cold, shock, and other hazards while allowing a user to quickly don and doff the gloves without having to contact any part of the glove's body.

It is another object of this invention to provide an anchoring point and magnetic member on the glove's inner wrist portion that cooperate with each other quickly and securely engage during the application or removal process.

It is still another object of this invention to provide protective gloves that can include a webbed configuration at the glove's finger portion to provide a user with greater dexterity when using the protective gloves.

It is yet another object of the present invention to provide protective gloves that come in abutting engagement and remain together during storage to prevent loss of the gloves.

It is another object of the present invention to provide gloves having a material that enhances their coefficient of friction to better grip objects.

It is yet another object of this invention to provide gloves that are inexpensive to implement and maintain while retaining its effectiveness.

It is yet another object of the present invention to provide gloves having wrist fastening means to seal the interior cavities of the gloves while they are being washed.

It is yet another object of the present invention to have a glove having lighting means to illuminate predetermined work areas.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
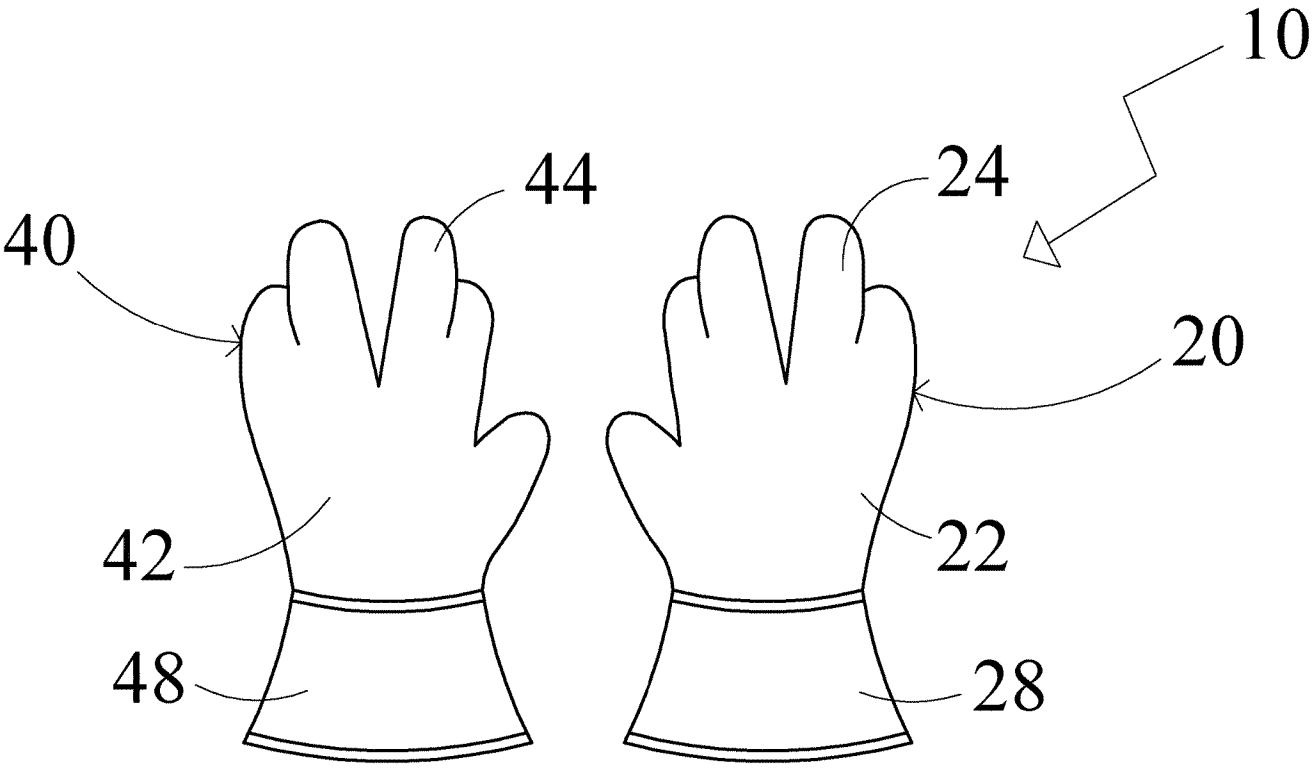
FIG. 1 represents a front elevational view of male glove assembly 20 showing the back of male glove body 22 with finger portion 24 in the webbed configuration. Female glove assembly 40 having female glove body 42 with finger portion 44 is also in the webbed configuration.

Referring now to the drawings, where the present invention is generally referred to with numeral 10, it can be observed that it basically includes male glove assembly 20, female glove assembly 40, male attachment assembly 60, and anchoring assembly 80.

As seen in FIG. 1, male glove assembly 20 includes male glove body 22 defining a user's hand and fingers portion 24 at the top of male glove body 22 defining a user's fingers, except thumb. Similarly, female glove body 40 includes female glove body 42 defining a user's opposite hand and fingers portion 44 at the top end defining a user's fingers, except thumb, on the opposite hand. In a preferred embodiment, shown in FIG. 1, fingers portions 24 and 44 can be configured to be webbed by fusing together the pinky and ring fingers while separately fusing together the index and middle fingers, thereby providing a user with great dexterity while making it easy for a user to don and doff male and female glove assemblies 20; 40.

Figure 1A:
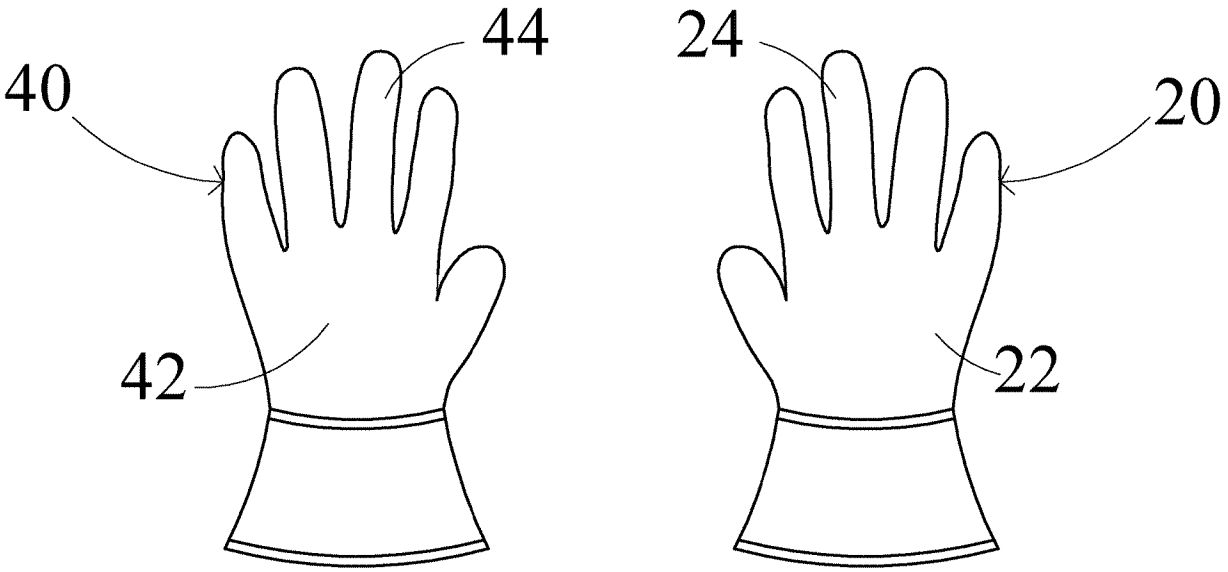
FIG. 1A shows a front elevational view of an alternate embodiment of male glove assembly 20 wherein finger portion 24 is in the independent finger configuration. Finger portion 44 of female glove assembly 40 is also in the independent configuration.
Figure 1B:
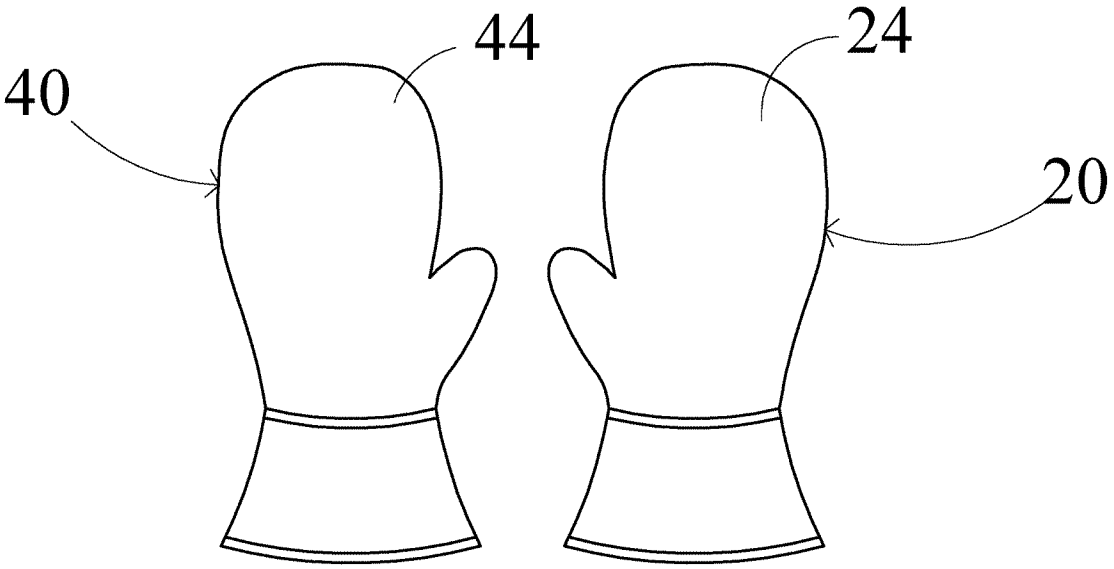
FIG. 1B illustrates a front elevational view of an alternate embodiment of male glove assembly 20 wherein finger portion 24 is in the mitten configuration. Finger portion 44 of female glove assembly 40 is also in the mitten configuration.

In an alternate embodiment, finger portions 24 and 44 can be configured independently to provide a user with additional dexterity, as seen in FIG. 1A. In yet another alternate embodiment shown in FIG. 1B finger portions 24 and 44 can be configured like a mitten to make it even easier for a user to don and doff male and female glove assemblies 20; 40.

Figure 2:
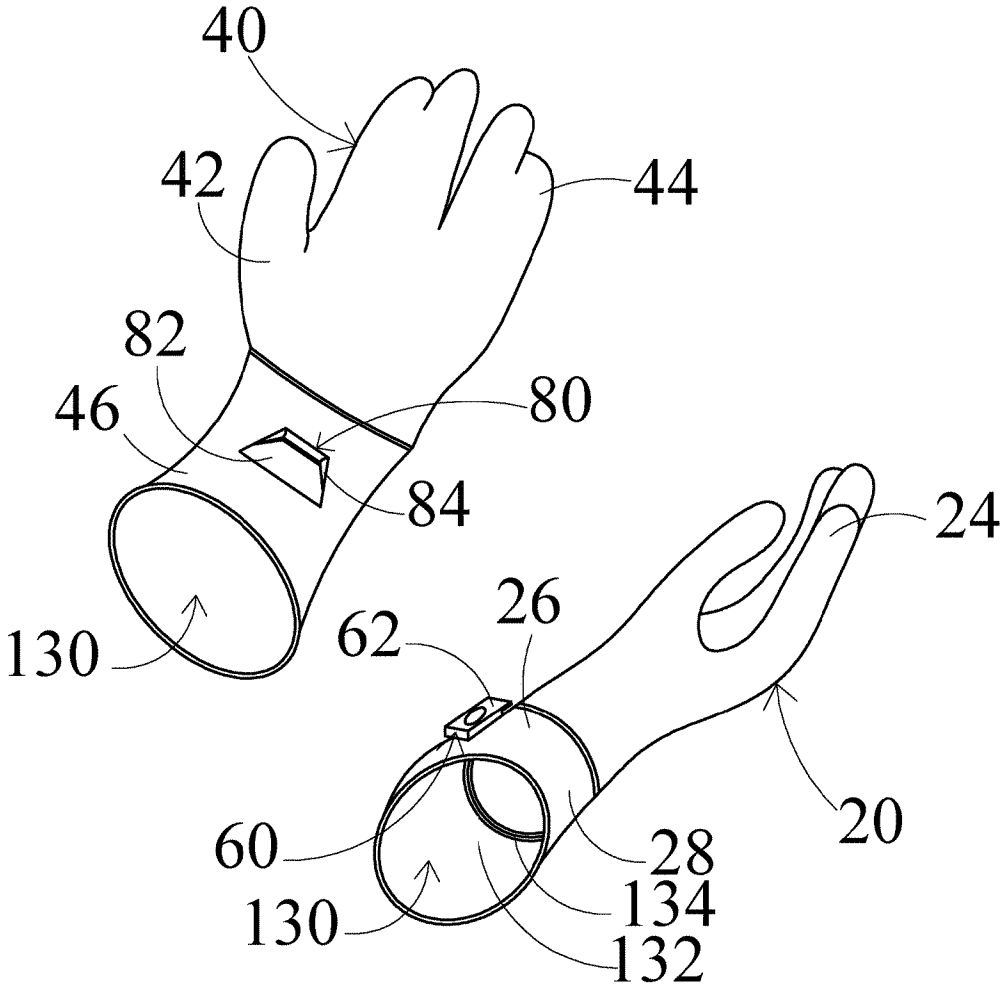
FIG. 2 is an isometric view showing male glove assembly 20 and female glove assembly 40 before coining into an abutting engagement so that a user can easily don, doff or store the gloves.
Figure 2A:
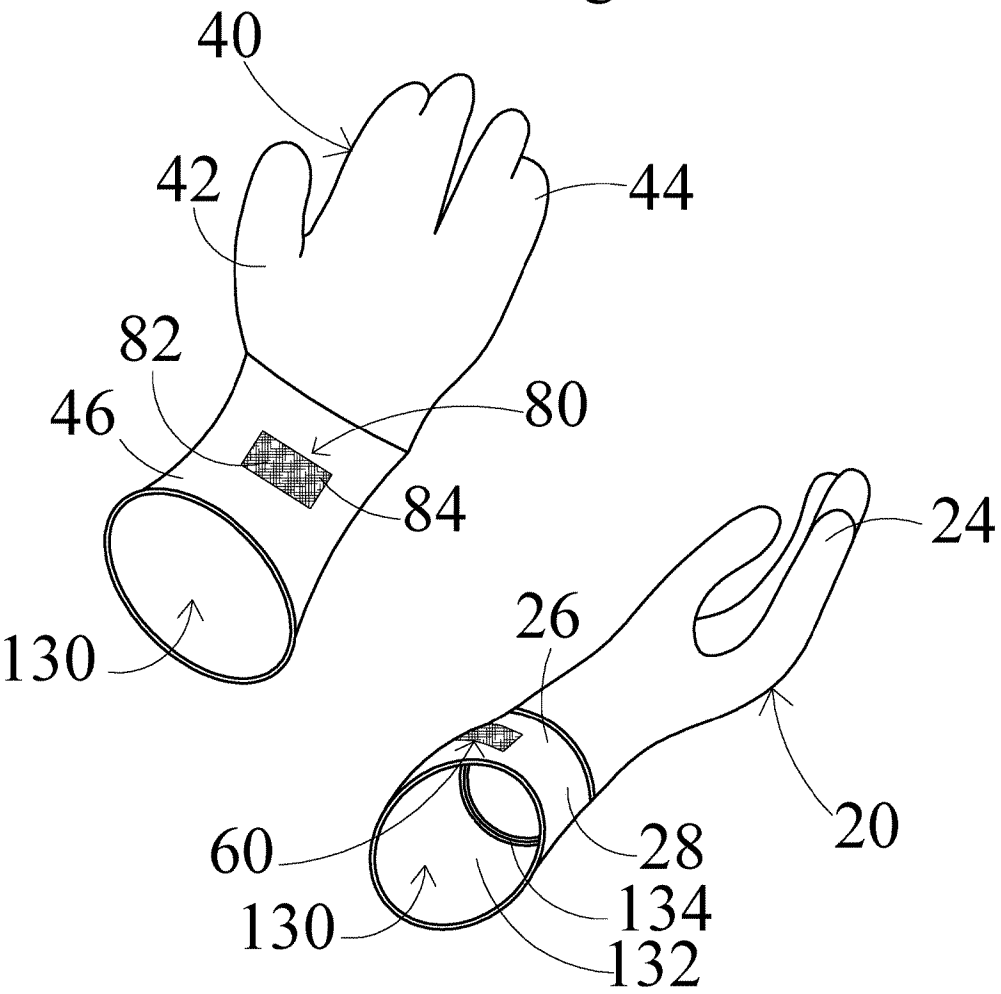
FIG. 2A is an isometric view of an alternate embodiment of male mounting attachment assembly 60 wherein a hook and loop fastener is used to mount male glove assembly 20 to female glove assembly 40. In this embodiment anchoring assembly 80 on female glove assembly 40 is the female end of a cooperating hook and loop fastener. Wrist fastening assembly 130 can be seen with wrist fastening means 134 in the open configuration.

As shown in FIG. 2, female and male glove bodies 22 and 42, respectively, come into abutting relationship using male attachment assembly 60 and anchoring assembly 80. Male attachment assembly 60 includes fastening member 62 mounted to inner wrist portion 26 of male glove body 22. In a preferred embodiment, fastening member 62 is a magnetic member as seen in FIG. 2. In an alternate embodiment, fastening member 62 is a hook and loop fastener as seen in FIG. 2A. In the alternate embodiment shown in FIG. 2A a receiving hook and loop fastening member is used in anchoring assembly 80.

As shown in FIG. 2, anchoring assembly 80 is mounted to inner wrist portion 46 of female glove assembly 40. Anchoring assembly 80 includes anchoring member 82 made to a predetermined shape, such as a circle, semi-circle, trapezoid, triangle, square, or rectangle and of a predetermined dimension that cooperates with engagement member 62. Anchoring assembly 80 further includes lip 84 on the distal end of anchoring member 82. Lip 84 provides a user with a point of leverage to abut against when donning or doffing glove assemblies 20 and 40. Anchoring member 82 is of a material that cooperates to engage engagement member 62. For instance, if engagement member 62 is a magnetic member then anchoring member 82 will be made of a type of a ferromagnetic material such as steel, iron, brass, zinc, copper, gold, nickel, magnesium or silver. As well, if anchoring member 82 is a magnetic member then engagement member 62 will be made out of ferromagnetic.

As seen in FIG. 2A, male and female glove assemblies 20 and 40 can include wrist fastening assemblies 130 having inner wrist portions 132 with wrist fastening means 134 mounted thereon. In a preferred embodiment, wrist fastening means 134 are zippers. In alternate embodiments, wrist fastening means 134 can be sliding zip fasteners similar to those used in storage bags sold under the registered trademark name Ziplock. Wrist fastening means 134 are used to seal wrist portions of glove assemblies 20 and 40 to keep the interior cavity of the glove assemblies separated from any liquids used when washing the gloves.

Figure 4:
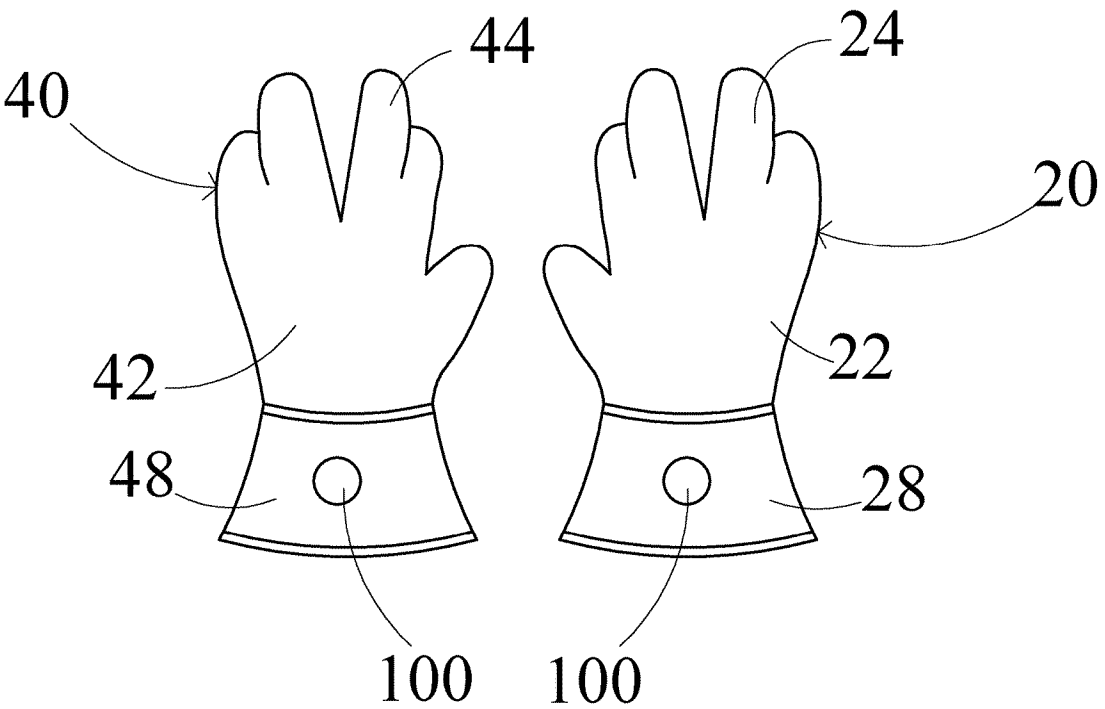
FIG. 4 is an elevational view showing the back of the gloves having magnetic members 100 on outer wrist portions 28; 48.
Figure 5:
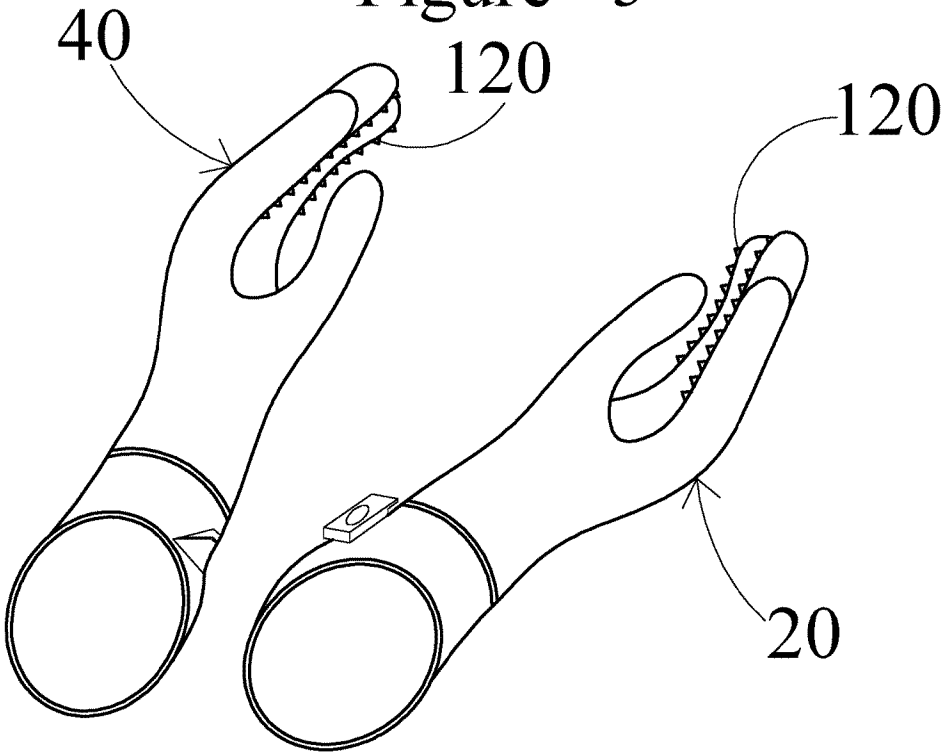
FIG. 5 shows grip material 120 on glove assemblies 20; 40 to enhance the coefficient of friction between the glove assemblies and preselected objects.
Figure 6:
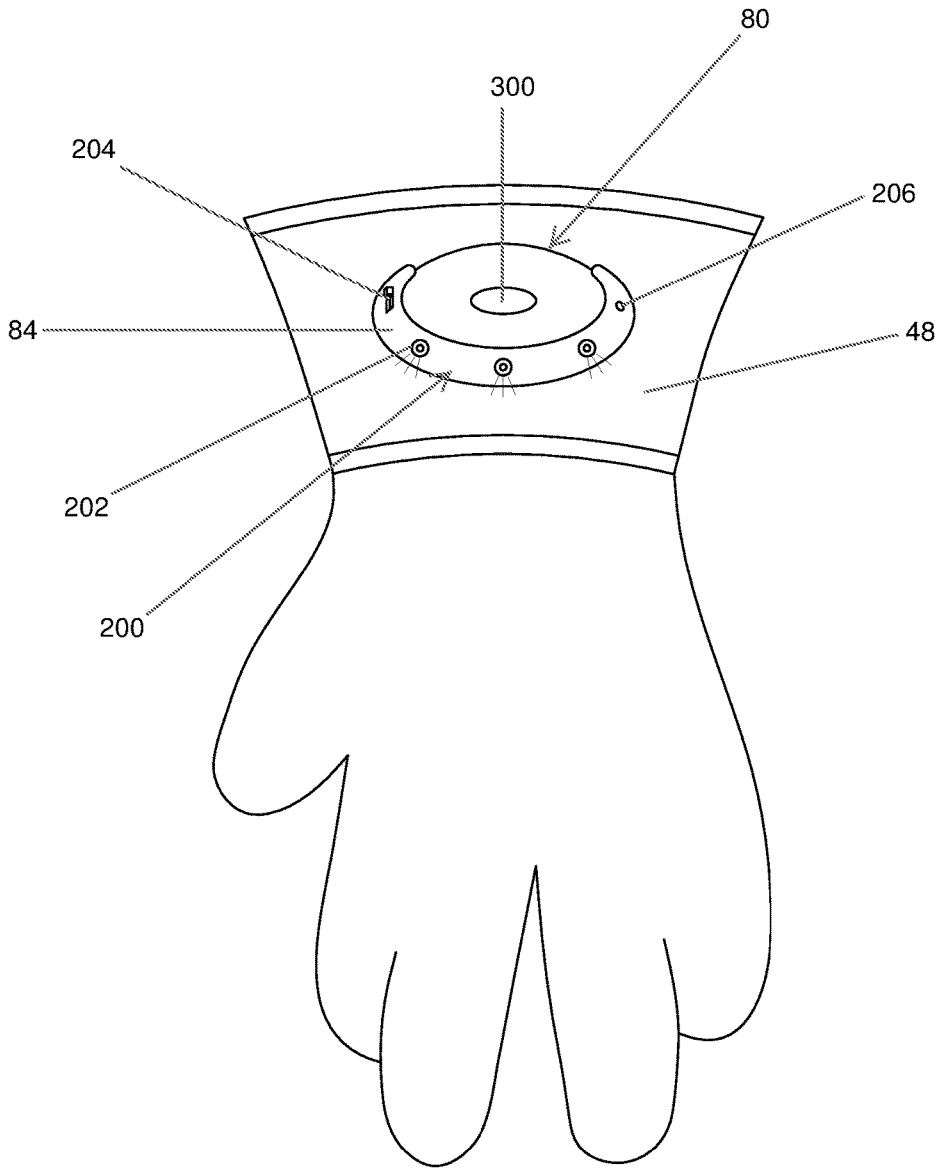
FIG. 6 shows a top plan view of the glove.

Male and female glove assemblies 20 and 40 can optionally include outer wrist assemblies 28 and 48, respectively. As shown in FIG. 4, outer wrist assemblies 28 and 48 include magnetic members 100 that can be used to mount the glove assemblies to any ferromagnetic material. It is understood that similar means can also be used to accomplish the same function such as hook and loop fasteners. In an alternate embodiment, shown in FIG. 5, a material with a high coefficient of friction 120 can be used with glove assemblies 20 and 40 to increase the grip of the gloves.

To don male and female glove assembles 20 and 40 a user begins by connecting both gloves together using engagement assembly 60 and anchoring assembly 80. The gloves are then substantially parallel and ready to be easily donned. Alternatively, a user can don each glove separately and begin using them. As the glove assemblies are mounted to each other, it is easier for a user to accommodate their hands inside the gloves using the leverage provided by the connection between engagement assembly 60 anchoring assembly 80.

Figure 3:
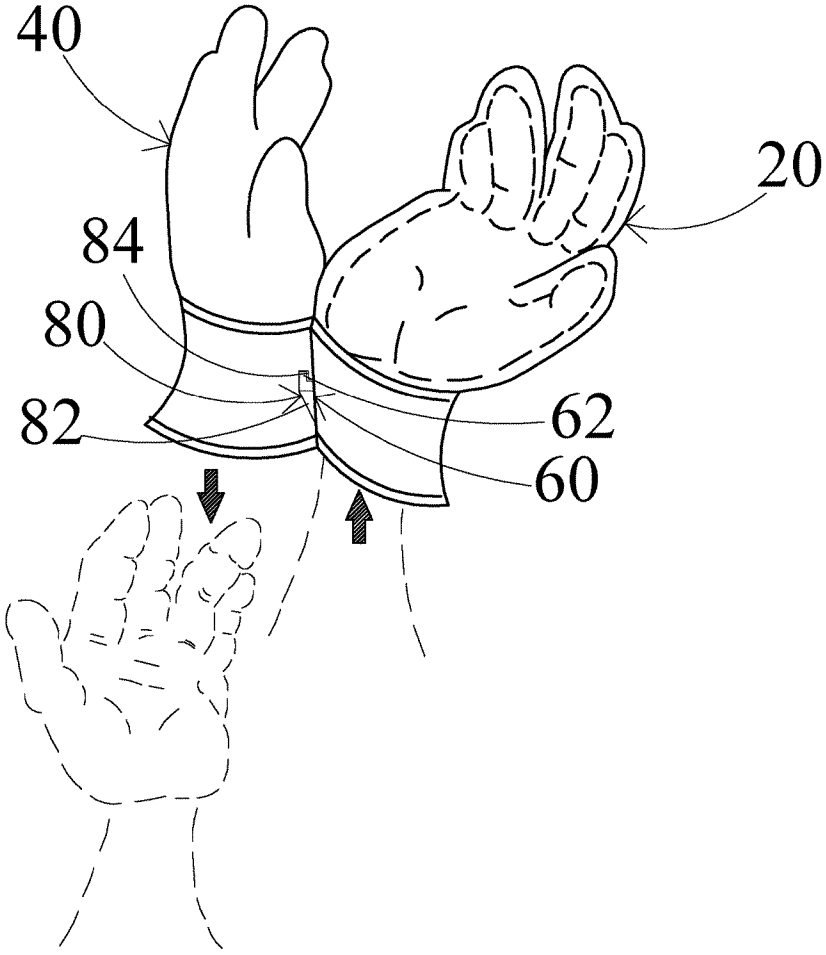
FIG. 3 illustrates an isometric view showing a user removing his hand from female glove assembly 40 by leveraging lip 84 of anchoring assembly 80 against magnetic member 62 of male attachment assembly 60.
Figure 3A:
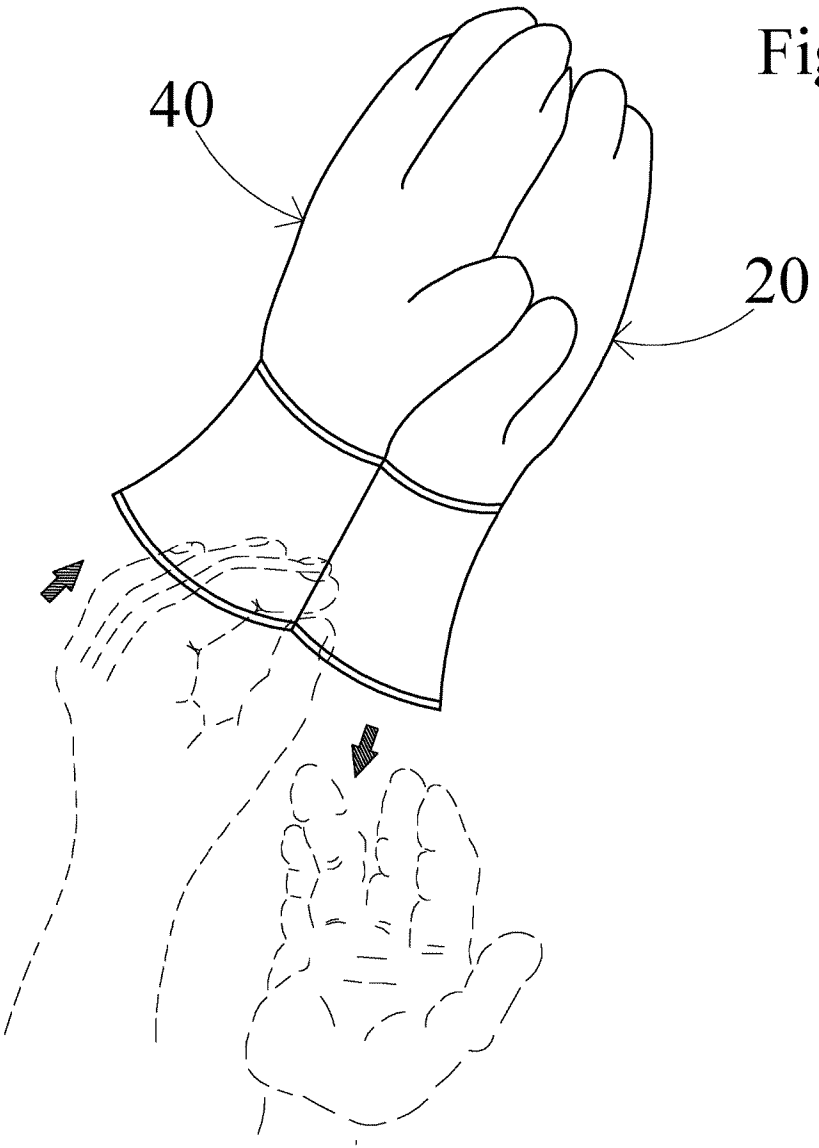
FIG. 3A represents an isometric view of a user removing male glove assembly 20 after having removed female glove assembly 40. Male and female glove assemblies 20; 40 respectively can be seen mounted to one another and ready to be stored together.

To remove male and female glove assemblies 20 and 40 a user positions engagement member 62 close enough to anchoring member 82 so that their ferromagnetic properties attract, thereby creating an engagement between male and female glove assemblies 20 and 40. As shown in FIG. 3, once engaged a user begins to push engagement member 62 against lip 84 the user can begin to slide his hand out of female glove assembly 40 as the glove remains mounted in the same position to male glove assembly 20. Before removing the hand completely the user can use the partially removed hand to apply pressure to male glove assembly 20 to provide leverage as the user partially removes his hand from male glove assembly 20. Once both hands are partially removed from the glove assemblies the user can easily doff the rest of the gloves. The above mentioned sequence can be inverted so that a user begins by partially removing the hand within male glove assembly 20 first.

Once both gloves have been removed from a user's hands they can remain mounted together using engagement assembly 60 and anchoring assembly 80 so that they can be stored together, reducing the likelihood of loss. Optionally, the gloves can be easily separated by pulling them away from each other in the event they need to be washed.

In an alternate embodiment, subject to this continuation in part, anchoring assembly 80 can include lighting assembly 200 along the length of lip 84. Lighting assembly 200 includes lighting means 200 which can be solar powered using solar cells not shown in the drawings or a battery housed within anchoring assembly 80. The battery housed within anchoring assembly 80 can be powered through USB port 206. Lighting assembly 200 further includes a power button 204 to activate the lighting means. Power button 204 can be in the form of a button or switch. Optionally, anchoring assembly 80 can include magnet 300 that creates a more secure engagement with fastening member 62 lighting means 202 can be configured to focus the light towards the finger portion of the glove. Lighting assembly 200 can be included on either male or female glove assemblies 20; 40, or on both. Instead of pushing power button 204, lighting means 202 can be set to automatically illuminate when it is dark, using a sensor.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A glove system including a male and female glove assembly each having a distal end located near a fingertip portion and a distal end located near a wrist portion, said male and female glove assemblies cooperating to engage at inner wrist portions of each of said glove assemblies using inner wrist fastening means, said inner wrist fastening means include an engagement member on said male glove assembly and an anchoring member on said female glove assembly, said anchoring member having a base, two sides and a top portion defining an attachment space, said top portion including a lip further defining said attachment space, said engagement member having a main body and an extension that projects away from said main body towards said fingertip portion, said main body having a thickness, said extension having a thickness that is smaller than said thickness of said main body and, said attachment space and said lip configured to engage said extension, thereby allowing a user to free one hand at a time from said glove assemblies while said glove assemblies remain attached to one another.

2. The glove system subject of claim 1 wherein said anchoring member is a magnetic member and said engagement member is a ferromagnetic member that attracts to said magnetic member.

3. The glove system subject of claim 1 wherein said glove assemblies include an outer wrist portion having outer wrist fastening means mounted thereon that permit a user to attach said glove assemblies to preselected objects.

4. The glove system subject of claim 3 wherein said outer wrist fastening means include magnetic members.

5. The glove system subject of claim 3 wherein said outer wrist fastening means include hook and loop fasteners.

6. The glove system subject of claim 1 wherein said glove assemblies include finger portions that can be configured in a webbed configuration having an index finger portion and a middle fingers\portion fused together on each glove assembly while also having a pinkie finger portion and a ring finger portion fused together on each glove assembly.

7. The glove system subject of claim 1 wherein said finger portions can be configured in a mitten configuration.

8. The glove system subject of claim 1 wherein said finger portions can be configured so that each finger portion is kept independent of the others on each glove assembly.

9. The glove system subject of claim 1 wherein said glove assemblies include a material with an increased coefficient of friction to provide more grip to said glove assemblies.

10. The glove system subject of claim 1 wherein said glove assemblies are made of a material that is heat resistant.

11. The glove system subject of claim 1 wherein said glove assemblies are made of a material that is shock resistant.

12. The glove system subject of claim 1 wherein said glove assemblies are made of a material that is cut resistant.

13. The glove system subject of claim 1 wherein said glove assemblies are made of an impermeable material.

14. The glove system subject of claim 1 wherein said glove assemblies include a wrist fastening means thereby selectively sealing an interior space of said glove assemblies.

15. The glove system subject of claim 14 wherein said wrist fastening means is a zipper.

16. The glove system subject of claim 14 wherein said wrist fastening means is a hook and loop fastener.

17. The glove system subject of claim 14 wherein said wrist fastening means is a zip sliding fastener.

18. The glove system subject of claim 1 wherein said engagement member is a magnetic member and said anchoring member is a ferromagnetic member that attracts to said magnetic member.

19. The glove system subject of claim 1 wherein said engagement member and said anchoring member each have a circular shape.

20. The glove system subject of claim 1 wherein said engagement member and said anchoring member each have a semi-circular shape.

21. The glove system subject of claim 1 wherein said lighting assembly includes a lighting means that is battery powered through a USB port.

22. The glove system subject of claim 1 wherein said lighting assembly includes a lighting means that is solar powered.

23. The glove system subject of claim 1 wherein said lighting assembly includes lighting means and a sensor that automatically activates said lighting means upon sensing a predetermined amount of darkness.

* * * * *